US006276077B1

(12) United States Patent
Kirbie

(10) Patent No.: US 6,276,077 B1
(45) Date of Patent: Aug. 21, 2001

(54) TILTABLE BUCKET, WHEEL TRACTOR SCRAPER

(75) Inventor: Martin Kirbie, Grand Prairie, TX (US)

(73) Assignee: JHC Holding Company, Irving, TX (US)

( * ) Notice: Subject to any disclaimer, the term of this patent is extended or adjusted under 35 U.S.C. 154(b) by 0 days.

(21) Appl. No.: 09/376,642

(22) Filed: Aug. 18, 1999

(51) Int. Cl.[7] ..... E02F 3/04

(52) U.S. Cl. ..... 37/417; 37/412; 172/783

(58) Field of Search ..... 37/304, 411, 412, 37/417, 414, 415; 172/781, 783, 799.5; 280/6.16, 6.15

(56) References Cited

U.S. PATENT DOCUMENTS

| | | | | |
|---|---|---|---|---|
| 1,014,989 | | 1/1912 | Adams et al. . | |
| 1,655,303 | | 1/1928 | Arndt . | |
| 1,811,661 | | 6/1931 | Beatty et al. . | |
| 2,057,086 | | 10/1936 | Millar | 37/156 |
| 2,450,200 | | 9/1948 | Locke | 37/178 |
| 2,874,490 | | 2/1959 | Harmon | 37/169 |
| 3,126,653 | * | 3/1964 | Bourgeous | 37/108 |
| 3,381,760 | | 5/1968 | Braud | 172/788 |
| 3,486,254 | | 12/1969 | Campbell | 37/129 |
| 3,561,538 | | 2/1971 | Curlett et al. | 172/4.5 |
| 3,711,971 | * | 1/1973 | Martin | 37/417 |
| 3,900,977 | * | 8/1975 | Hyler | 37/414 |
| 3,903,623 | | 9/1975 | Hyler | 37/8 |
| 3,905,136 | | 9/1975 | Hyler | 37/8 |
| 3,984,927 | | 10/1976 | Hyler | 37/8 |
| 4,053,171 | * | 10/1977 | Hyler et al. | 280/124.116 |
| 4,175,625 | | 11/1979 | Puckett | 172/791 |
| 4,207,691 | * | 6/1980 | Hyler et al. | 37/413 |
| 4,552,238 | * | 11/1985 | Joyce, Jr. | 172/783 |
| 4,798,398 | * | 1/1989 | Cummins | 280/708 |
| 5,561,924 | * | 10/1996 | Ramey | 37/415 |
| 6,112,828 | * | 9/2000 | Leal | 172/799.5 |

* cited by examiner

*Primary Examiner*—Thomas B. Will
*Assistant Examiner*—Nathan Mammen
(74) *Attorney, Agent, or Firm*—John W. Montgomery; Haynes and Boone, L.L.P.

(57) ABSTRACT

A wheel tractor scraper is provided with a tractor and a bucket having a bottom, a left side, a right side, a back end and a front end defining a bowl for collecting dirt and having an open front portion and a scraper blade attached along the front portion and at the bottom of the bucket for scraping dirt into the bucket. The bucket is rollingly supported on an axle between left and right rear wheels. A draft frame pivotably connects between the tractor and the bucket. A pair of cylinders is operatively connected to the bucket and the cylinders are actuatable to provide vertical components of force to tilt the bucket, up on one side and down on the other side of the bucket to thereby controllably tilt the bucket and the scraper blade attached thereto for scraping dirt at a cross-grade angle relative to the axle and wheels.

2 Claims, 3 Drawing Sheets

TILTABLE BUCKET, WHEEL TRACTOR SCRAPER

TECHNICAL FIELD OF THE INVENTION

The present invention relates to road working heavy equipment and, more particularly, to an improved wheel tractor scraper used for removing dirt to prepare a roadway for paving or for other surface preparation.

BACKGROUND OF THE INVENTION

Wheel tractor scrapers are used to remove dirt for preparing a roadway for paving or for other road surface preparation. Such wheel tractor scrapers, as the Caterpillar® model 631E, are typically driven in the direction of the roadway and remove dirt to an appropriate depth, according to survey stakes positioned alongside the proposed roadway. The dirt is simultaneously removed as the ground below is leveled for providing an acceptably flat and smooth roadway. All standard highways and roads are desirably crowned in a parabolic shape, high in the middle and low along the edges of the roadway, primarily to facilitate drainage and also, to a lesser degree, to increase strength through the upwardly curved arch shape and to enhance safety by slanting each side of the roadway in opposite directions so that vehicles will have a tendency, although mostly imperceivable, to move away from the center. When a vehicle is not properly guided by an inattentive operator, it will drift to the side and away from oncoming traffic.

In order to provide the desirable parabolic crown or arch shape to the roadway, an existing wheel tractor scraper can be used to the surface only to the highest desired depth at the center of the road. Another piece of equipment, such as a road grader, must then be used to blade the dirt away from the edges on both sides of center. Graded dirt may also accumulate and may need to be removed from the roadway using one or two other pieces of equipment, such as the tractor wheel scraper or a front-end loader and a dump truck.

Prior U.S. Pat. No. 3,561,538 discloses an earth-moving machine with depth and cross-slope control. This machine provides for depth control using a pair of hydraulically operated rams that operate in parallel, i.e., both rams acting simultaneously up or down at the front of the main member so that the height of the blade is adjusted. The cross-slope is adjusted with a single hydraulically-operated ram operating against pivotable brackets which support one rear wheel by raising and lowering one of the rear wheels; the cross-grade is said to be adjustable. This prior device requires a specially constructed rear axle bracket and brace support that presents certain inherent suspension difficulty and reduced load-carrying capacity and has not been a widely accepted machine design.

Other prior tractor scrapers with material collection bowls, such as in U.S. Pat. No. 3,905,136 and U.S. Pat. No. 3,486,254 and U.S. Pat. No. 3,984,927 consistently describe tilting the front of the bowl downwardly or upwardly to adjust the depth of cut only with parallel actuation of hydraulic cylinders and rams or hydraulic actuators. In each of these prior devices, the front blade is tilted downward or upward, thereby adjusting the depth of the cut but not adjusting the cross-grade cutting angle.

SUMMARY OF THE INVENTION

The present invention provides a single vehicle that can remove dirt from a roadway while forming a desirable crown shape therealong. The invention basically comprises a structure of a vehicle, such as a wheel tractor scraper, including a tractor and driver cab, a bucket with a frontward-directed scraper blade mounted on a pair of wheels and turnably connected by a draft frame to the tractor behind the drivers cab. Front hydraulic cylinders and rams are mounted, one each at opposite sides of the draft frame toward the front of the bucket and above the scraper blade. The hydraulic cylinders and rams are selectively actuatable from the driver cab. To form a crown, the hydraulic cylinders are uniquely constructed and controlled to be selectively actuatable, both to control the depth of cut and control the cross-grade angle of the scraper blade. To control depth of cut, both cylinders ad rams operate in parallel. To control the cross-blade angle, the cylinders and rams operate in relative opposite directions. The cylinder on one side lifts the front of the scraper blade and the cylinder on the opposite side of center pushes the scraper blade downward. Thus, one front corner of the scraper is lower than the other front corner and the edge of the roadway can be made lower than the middle. With the cross-angle established, both cylinders and rams can be actuated in parallel or in the same direction to adjust the depth of cut while maintaining the cross-angle or the "stagger." The actuation maintaining the different extension of each ram is sometimes referred to as staggered actuation. The hydraulic cylinders and rams are dual actuation cylinders so that the blade may be adjustably maintained at the appropriate depth and cross-angle with respect to the roadway, to form a roadway with a single machine at a desired cross-grade. The cross-grade angle can be adjustably controlled, depending on whether one of the other edges of the roadway is being formed or whether a portion closer to the center of the parabolic curve shape or at the top of the roadway crown is being formed.

The tiltable bucket, wheel tractor scraper, according to the present invention, can therefore be used to form appropriate angles for a parabolic crown, up at center of the roadway, down at the side edges and at other angles therebetween. The inventive tiltable bucket, tractor wheel scraper alleviates the need for a separate piece of heavy equipment, such as a road grader. The inventive tiltable bucket, wheel tractor scraper is not only capable of removing dirt to an adjustable depth with a blade parallel to the wheels carrying the bucket, as with prior wheel tractor scrapers, but can also scrape and remove dirt to a simultaneously adjustable depth and adjustable cross-grade angle along any portion of the roadway crown or along either of the sloped edges of roadways.

In an alternative embodiment, in order to accomplish the cross-grade tiltability of the bucket blade, the entire bucket may be attached to the rear axle between the rear wheels using two adjustably inflatable nitrogen cylinders. Prior proposals for hydraulic adjustment of one of the rear wheels did not accommodate cushioned suspension as with the inventive dual nitrogen cylinder aspect of this embodiment of the invention. Prior devices might have used nitrogen cylinders for shock absorbing. The separately adjustable nitrogen cylinders attached according to this embodiment of the invention may be inflated or deflated in parallel to change the angle of forward tilt of the blade. The nitrogen cylinders may be selectively inflated and deflated with opposite, direct actuation to adjust the cross-grade or with staggered actuation to adjust both forward tilt and cross-grade tilt simultaneously. Thus, the entire bucket, including the blade, may be pivoted at its connection to the center beam and relative to the rear axle. The depth of cut could be controlled by standard dual parallel action front cylinders and rams.

In another embodiment, the actuation of two front hydraulic cylinders and rams act in coordination with two rear nitrogen cylinders to allow the scraper blade and the entire scraper blade bucket to more easily tilted about either a front-to-back imaginary control axis or an imaginary transverse axis to obtain any desired blade of angle and depth relative to the roadway. Preferably, the rear nitrogen cylinders and the front hydraulic cylinders and rams are controlled simultaneously by the operator using a simplified two-axis tilt controller arrangement that actuates both hydraulic and nitrogen cylinders to accomplish the desired blade attack angle, depth of cut and crown-forming, cross-grade scraping angle.

The invention further contemplates a kit for modification of existing wheel tractor scrapers, with either the front hydraulic cylinders and rams and controls, the rear nitrogen cylinders and controls, or the combination of hydraulic cylinders and rams and the rear nitrogen cylinders with corresponding coordinated controls. Further alternatively, the invention may be practiced by constructing a new vehicle with either or both the front hydraulic cylinders and rams and the rear nitrogen cylinders and controls and an appropriately connected bucket and scraper blade.

BRIEF DESCRIPTION OF THE DRAWINGS

The foregoing objects, advantages, and features, as well as other objects and advantages, will become more apparent with reference to the description, the claims and drawings below, in which like numerals represent like elements and in which:

DETAILED DESCRIPTION OF THE PREFERRED EMBODIMENTS

Figure 1:
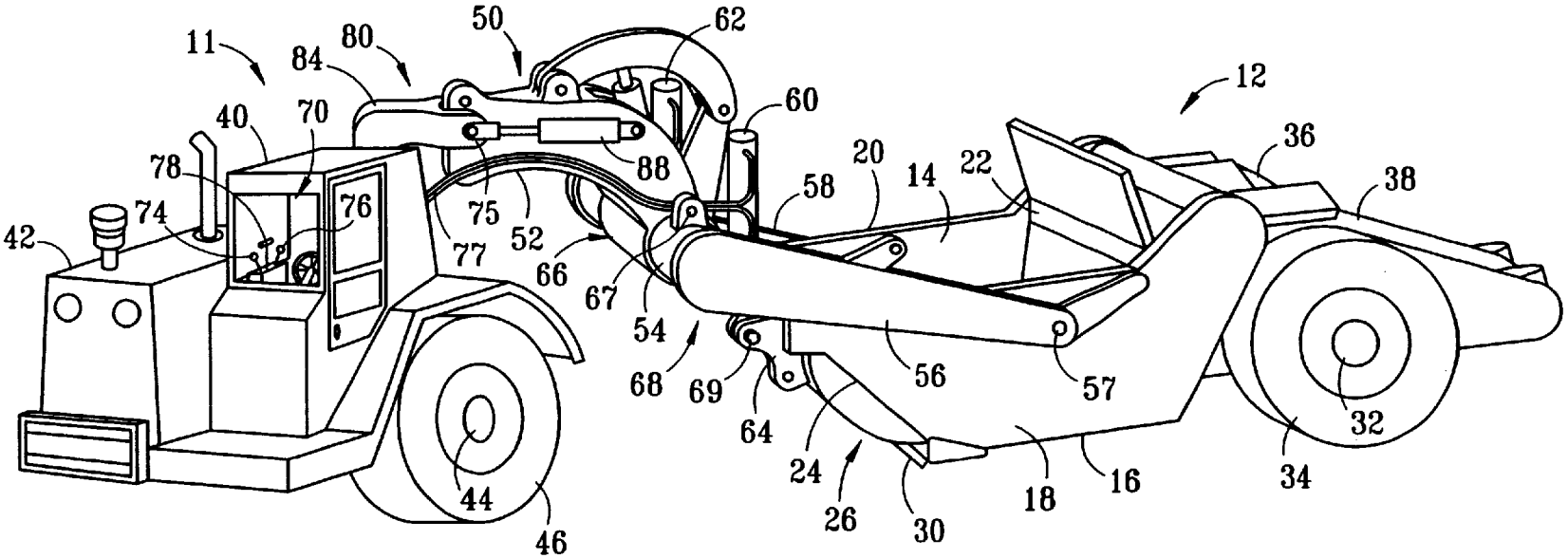
FIG. 1 is a schematic side perspective view of a wheel tractor scraper according to one embodiment of the present invention.

FIG. 1 is a schematic side perspective view showing a wheel tractor scraper 10 according to one embodiment of the present invention, including a scraper bucket wheel assembly 12 pulled by a tractor 11. The wheeled scraper bucket 12 includes an open bucket 14, sometimes referred to as a bowl 14 defined by a bottom 16, left side 18, right side 20, back end 22 and front end 24. The front end 24 includes an open front portion 26 and a scraper blade 30 attached along the front of the bucket bottom 16. The bucket 14 and attached scraper blade 30 are rollingly supported through a rear axle 32, having a left rear wheel 34 and a right rear wheel 36 attached to either end of the rear axle 32. An axle support frame 38 connects the rear axle 32 to the bucket 14, forming the wheeled scraper bucket assembly. A tractor cab 40, having a motor 42 with a drive train, including axles 44 connected to a left drive wheel and a right drive wheel (right drive wheel not shown in FIG. 1). A draft frame 50 connects between the wheeled bucket scraper assembly 12 and the tractor 10. The draft frame 50 comprises a center beam 52, sometimes referred to as a "gooseneck" because of the arch shape it makes to provide clearance between the tractor and the wheeled bucket scraper assembly. The draft frame 50 further includes a transverse bar 54 with rearwardly extending left draw arm 56 and right draw arm 58 that pivotably connect to the left side at left pivot connection 57 and to the right side 58 at right pivot connection 59 to the left 18 and right 20 of bucket 14 respectively.

Figure 2:
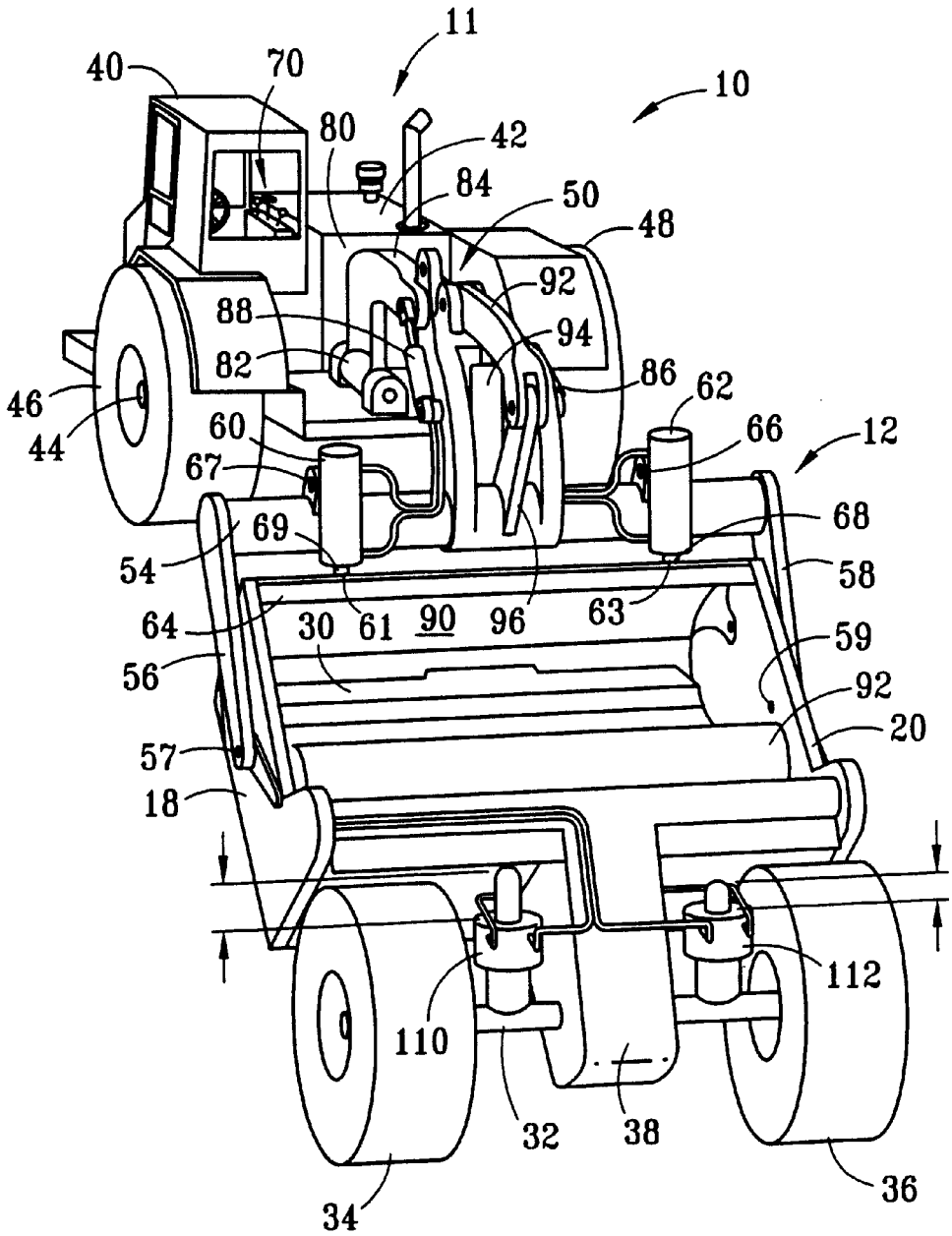
FIG. 2 is a schematic perspective view from the rear of a wheel tractor scraper according to one embodiment of the present invention.

Reference to FIG. 1 together with FIG. 2, that is a perspective view from a top, rear vantage point will further assist understanding of the invention. A right cylinder 60 with ram 61 and a left cylinder 62 and ram 63 are connected between the transverse bar 54 and a horizontal brace 64 attached along the top of the front 24 of bucket 14. The right cylinder 60 attaches at a right hinge connection 66 and the left cylinder 62 attaches at a left hinge connection 67. The distal end of right ram 61 attaches to the horizontal brace 64 at right connector 68 and the distal end of the left ram 63 connects to the horizontal brace 64 at a left connector 69.

Schematically depicted inside of cab 40 of the tractor 11 and extending back to hydraulic cylinders 60 and 62 are hydraulic controls 70. The hydraulic controls include a left tilt control 74 and left hydraulic lines 75. There are also a right tilt control 76 and right hydraulic lines 77. A staggered control 78 operates both cylinders simultaneously while maintaining a desired tilt.

The control 78 generally operates the left and right cylinders and rams 60 and 61 and 62 and 63 up and down with a dual action hydraulic cylinders 60 and 62. The cross-grade angle is adjusted by operating cylinder 60 in one direction and cylinder 62 in another direction until a desired stagger is accomplished. After the stagger is accomplished to provide the appropriate cross-grade tilt of the bucket 14 and the attached scraper blade 30, then the depth of cut can be adjusted with the stagger control 78.

With reference also to FIG. 2, which is a perspective view of the truck 10 and bucket and scraper wheel assembly 12, additional features of the invention may be more fully understood. The draft frame 50 is attached to the truck at a hitch 80 designed for vertical and horizontal pivoting. The vertical pivot is at 82 and the horizontal pivot is depicted at 84. A left horizontal pivot cylinder 86 and a right horizontal pivot cylinder 88 are provided on either side of the draft frame 50 to maintain control of the bucket scraper wheel assembly 12 when turns are being made.

Also depicted in this view is a front apron 90, a front apron lift arm 92 and the apron lift cylinder and ram 94. The apron lift arm is connected to the apron 90 with an apron connector rod 96. With this, the front of the front of bucket 14 may be closed or partially closed to keep its load secure and may be lifted open to allow scraping to proceed at scraper blade 30.

Figure 3:
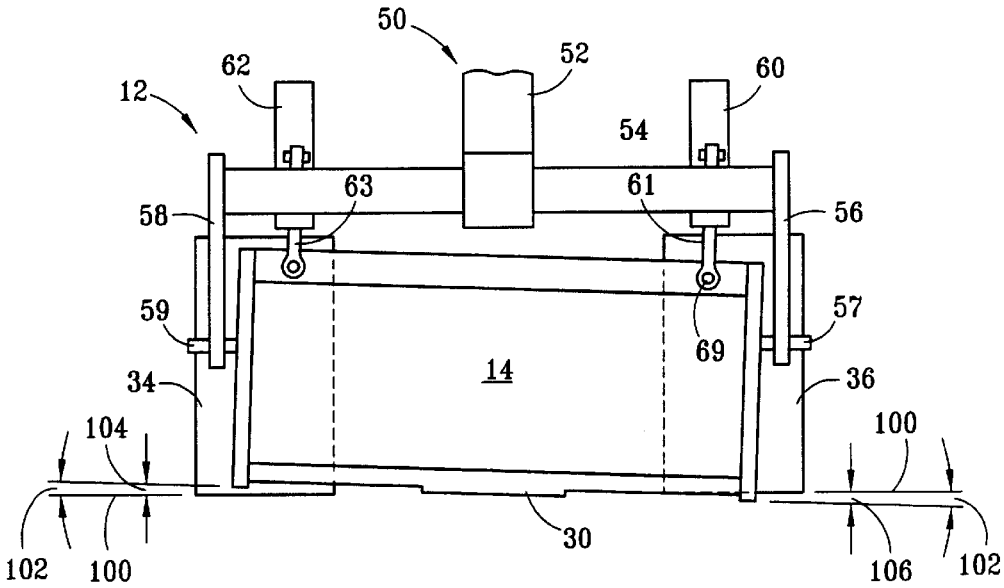
FIG. 3 is a schematic depiction of the front of the tiltable bucket, wheel tractor scraper in a position relative to a roadway depicting (in phantom lines) the crown-forming, angled position achieved through activation of the tilting cylinders.

FIG. 3 is a schematic front view of the bucket scraper wheel assembly 12 with a partial cross-section laterally through the center beam 52 of draft frame 50. In this figure, the ground is schematically represented as a line 100 and the desired cross-tilt angle or cross-grade angle is schematically depicted as angle 102, this cross-grade angle is desirably about five degrees cross-grade at the edges of the roadway and decreasing toward the center or top of the crown of the roadway where the angle would be zero. The opposite side of the roadway at the outer edge would be a negative five or six degrees. It has been found that for the width of a tractor scraper of 7–8 feet, the right cylinder and ram 62 and 63 can be actuated to lift approximately three inches at right corner 104 and the left cylinder 60 and ram 61 can be actuated to push the left corner 106 of scraper blade 30 downward approximately three inches at 106. For a scraper blade having a width of 11–12 feet, the raising and lowering of each corner would be correspondingly increased to about six inches each. Under normal construction of a tractor blade scraper, it has been found that a sufficient amount of flexure, without straining the material, is permitted in the arms 56 and 58 in combination with flexure in the pivot points 57 and 59, together with flexure in other parts of the structure. This small amount of deflection over the 7–12 foot span of the blade 30 can easily be accomplished with the oppositely-directed actuation of dual actuating cylinders 62 and 60.

Thus, in the embodiment depicted in FIG. 3, a vehicle can be constructed with the tilt controls and stagger controls for the dual actuating hydraulic cylinders and rams on either side of the draft frame. The cylinders and rams are attached between horizontal draw bar 54 and the horizontal brace 64 of bucket 14. The wheels 34 and 36 merely track along the ground or roadway and the appropriately angled blading is adjusted. A single machine accomplishes a crowned road preparation where two or more machines were previously required.

It is further envisioned in the present invention to provide a kit by which the hydraulic controls in an existing tractor wheel scraper can be replaced with controls allowing opposite direction, actuation of dual actuation cylinders 60 and 62. An adjustable stagger control 78 beneficially allows the angle and depth of cut to be automatically controlled, so that the desired cross-grade tilt angle can be accomplished and maintained.

Figure 4:
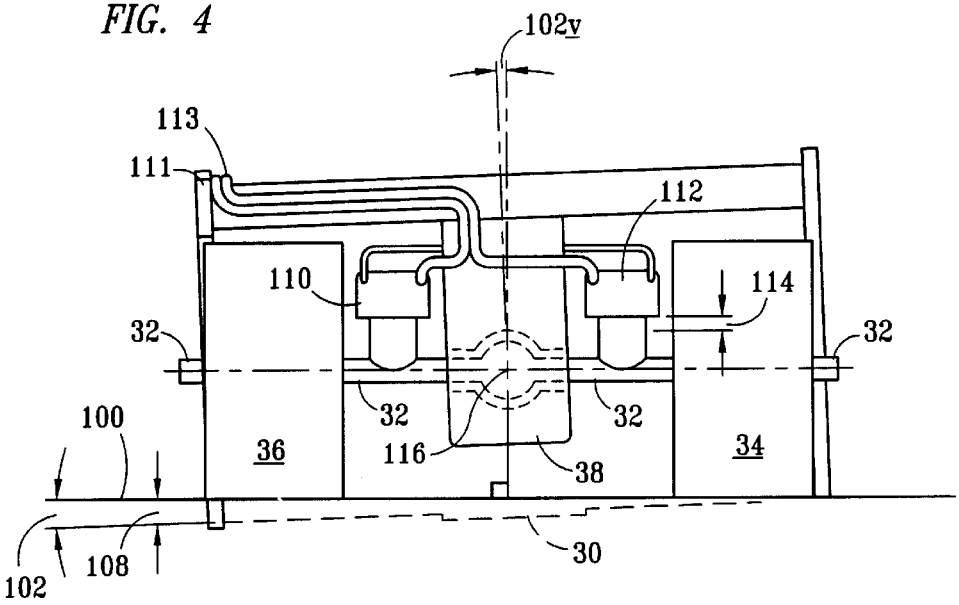
FIG. 4 is a schematic rear view of an alternative embodiment of a tiltable bucket, wheel tractor scraper according to the present invention in which a pair of nitrogen cylinder axle mounts is depicted by which the entire bucket may be more readily tilted for forming a desired crown-forming angle relative to a roadway.

With reference to FIG. 2 above, in conjunction with FIG. 4, an alternative embodiment of the invention may be more fully understood. FIG. 4 is a rear elevation view of the bucket scraper wheel assembly 12 in which a left wheel 36 and right wheel 34 are shown rolling along ground 100 into a roadway that is to be formed. The desired cross-grade tilt angle 102 for blade 30 is shown in phantom lines as it is buried in the dirt ahead of the wheels. The cross-grade tile is accomplished with left cylinder 110 and right cylinder 112 that connect the bucket 14 to the rear axle 32 at a left and right position on axle support 38. The tilt controls 70 can be operatively connected. In the preferred embodiment, these cylinders correspond to adjustably inflatable, nitrogen cylinders 110 and 112, and the tilt control 70 activates nitrogen control lines 113 and 111 to adjustably and separately control the inflation of nitrogen cylinders 110 and 112. As depicted in FIG. 4, a total tilt distance of five to six inches at 108 can be accomplished to produce the desired stagger distance, schematically depicted at 114 in FIG. 4, corresponding to the difference in extension between cylinders 110 and 112, that is only about one-half of the total blade tilt distance 108. The length of the scraper blade beyond the cylinder connection points increases the total amount of tilt. Thus, in the embodiment depicted in FIG. 4, nitrogen cylinders 110 and 112 may be controlled at 70 from the tractor cab 40 to obtain the desired bucket cross-grade tilt to form the hyperbolic crown on a roadway in a single pass according to the present invention. The use of two nitrogen cylinders is desirable over a single cylinder actuation to tilt the rear axle because the suspension of many heavy construction vehicles uses a nitrogen gas dampening cylinder system attached to either side of the axle for bounce control and to otherwise smooth the ride. Converting this type of suspension to separately adjustable nitrogen cylinders and appropriately connected controls does not require complex, special, new design of the rear suspension.

In yet a further alternative embodiment, both the hydraulic cylinders 60 and 62 and the nitrogen cylinders 110 and 112 may be attached to a single vehicle so that the cross-grade tile of both the front and the rear of the bucket 14 are simultaneously adjusted for the proper cross-grade scraping. Either the front and rear cylinders can be simultaneously adjusted with a single control or separate controls 70 and 71 can be used to selectively operate the front or rear cylinders as desired. A further advantage of separate front and back tilt control is that the fore and aft angle of the bucket can also be adjusted so that the scraper blade attack angle might be adjustably changed by lifting the rear of the bucket and pushing the front of the bucket downward or, alternatively, lowering the rear and lifting the front slightly while still maintaining the proper depth of cut to lessen the scraper blade attack angle. The amount of adjustment, although slight, can improve the efficiency of the scraping action, depending on the type of ground material being scraped.

Thus, what has been disclosed is a tiltable bucket, tractor wheel scraper in which the bucket may be tilted for proper cross-angle as well as tilted forward to adjusting the depth of cut. Further, this has been accomplished with dual actuation hydraulic cylinders or adjustably inflatable nitrogen cylinders, or both, with appropriate hydraulic and/or nitrogen gas inflation and deflation controls operated by the user from the cab.

Other alterations and modifications of the invention will likewise become apparent to those of ordinary skill in the art upon reading the present disclosure, and it is intended that the scope of the invention disclosed herein be limited only by the broadest interpretation of the appended claims to which the inventor is legally entitled.

What is claimed is:

1. A wheel tractor scraper comprising:

a. a tractor;

b. a bucket having a bottom, a left side, a right side, a back end and a front end defining a bowl for collecting dirt and having an open front portion and a scraper blade attached along said front portion and at said bottom of said bucket for scraping dirt into said bucket, said bucket rollingly supported on an axle between left and right rear wheels;

c. a draft frame pivotably connected between said tractor and said bucket;

d. a pair of cylinders operatively connected to said bucket and actuatable to provide vertical components of force to tilt said bucket, up on one of said right or left sides and down on the other one of said left or right sides of said bucket to thereby controllably tilt said bucket and said scraper blade attached thereto for scraping dirt at a cross-grade angle relative to said axle and wheels, wherein said pair of cylinders comprise left and right dual actuatable front cylinders and rams vertically attached between said draft frame and said front end of said bucket, one of said pair of front cylinders being positioned left of an imaginary centerline through said bucket from front to back and the other of said pair of front cylinders being positioned right of said imaginary centerline through said bucket and further comprising actuation controls operatively connected to expand one of said pair of dual actuatable front cylinders and rams while contracting the other or to contract one of said pair of dual actuatable front cylinders and rams while expanding the other so that said scraper blade at said front of said bucket is controllably tiltable, wherein said pair dual actuatable of cylinders and rams comprise hydraulic cylinders and rams and said actuation controls comprise hydraulic controls and hydraulic lines connected to said hydraulic cylinders and rams; and e. further comprising a pair of rear cylinders comprising right rear and left rear cylinders, connected between said rear axle and said back of said bucket at left and right of said front-to-back imaginary centerline of said bucket and further comprising actuation controls operatively connected to expand said right rear cylinder while contracting said left rear cylinder, or to contract said right rear cylinder while expanding said left rear cylinder so that said scraper blade attached to said front of said bucket is controllably tiltable.

2. A wheel tractor scraper as in claim 1 wherein rear cylinders attached between said left and right of said rear axle comprise expandable and contractible nitrogen gas cylinders and said controls comprise nitrogen gas controls and gas lines connected to said nitrogen gas cylinders.

* * * * *